US010762835B2

(12) United States Patent
Choi et al.

(10) Patent No.: US 10,762,835 B2
(45) Date of Patent: Sep. 1, 2020

(54) DISPLAY DEVICE AND DRIVING METHOD THEREOF

(71) Applicant: LG Display Co., Ltd., Seoul (KR)

(72) Inventors: Jintaek Choi, Paju-si (KR); Kipyo Hong, Paju-si (KR); Jooyoung An, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/191,875

(22) Filed: Nov. 15, 2018

(65) Prior Publication Data

US 2019/0189050 A1 Jun. 20, 2019

(30) Foreign Application Priority Data

Dec. 20, 2017 (KR) ..... 10-2017-0175987

(51) Int. Cl.
*G09G 3/3225* (2016.01)

(52) U.S. Cl.
CPC ..... *G09G 3/3225* (2013.01); *G09G 2320/048* (2013.01)

(58) Field of Classification Search
CPC ..... G09G 3/3225; G09G 2320/048; G09G 2300/0819; G09G 2320/029; G09G 2320/045; G09G 3/3291; G09G 3/3233
See application file for complete search history.

(56) References Cited

U.S. PATENT DOCUMENTS

2010/0225634 A1* 9/2010 Levey ..... G09G 3/3208 345/212

FOREIGN PATENT DOCUMENTS

KR 10-2017-0081085 A 7/2017

* cited by examiner

*Primary Examiner* — Andrew Sasinowski
(74) *Attorney, Agent, or Firm* — Morgan, Lewis & Bockius LLP

(57) ABSTRACT

The present disclosure a display device includes: a display panel including subpixels displaying an image; and a life controller controlling at least any one of a compensation rate and a delay rate of the subpixels on the basis of usage data obtained by calculating usage of the display panel and life data of the subpixels.

11 Claims, 9 Drawing Sheets

DISPLAY DEVICE AND DRIVING METHOD THEREOF

This application claims the benefit of Korean Patent Application No. 10-2017-0175987, filed Dec. 20, 2017, which is hereby incorporated by reference.

BACKGROUND

1. Technical Field

The present disclosure relates to a display device and a driving method thereof.

2. Description of Related Art

As the information technology is developed, the market for display devices as connection mediums between users and information has increased. Accordingly, the use of an organic light emitting display device is increasing.

An organic light emitting display device includes a display panel including a plurality of sub-pixels, a driver outputting a driving signal for driving the display panel, and a power supply unit generating power to be supplied to the display panel and the driver. The driver includes a scan driver supplying a scan signal (or a gate signal) to the display panel, a data driver for supplying a data signal to the display panel, and a data driver supplying a data signal to the display panel.

An organic light emitting display device includes a driving thin film transistor (TFT) adjusting a driving current flowing in a light emitting diode included in a subpixel and a plurality of switching TFTs. Elements included in a pixel must be designed for controlling a driving current flowing in a light emitting diode included in a sub pixel. The elements included in all pixels must be designed to be the same, but characteristics such as performance and the life of actual elements, and the like, are uneven according to process variations, driving time, and driving environments, and the like.

Such non-uniformity causes a compensation error when sensing/non-sensing compensation is performed. Therefore, it is required to do research into a compensation method for reducing the problem that the life of a display panel is shortened and a difference in degradation between subpixels in consideration of non-uniform performance and life distribution of the elements included in the subpixels.

SUMMARY

Accordingly, embodiments of the present disclosure are directed to a display device and a driving method thereof that substantially obviate one or more of the problems due to limitations and disadvantages of the related art.

An aspect of the present disclosure is to perform compensation such that all the elements included in a display panel have the same life by reflecting life characteristics of the elements, whereby a difference in degradation between neighboring pixels is reduced and the entire region of the display panel is degraded at a substantially uniform rate.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device comprises: a display panel including subpixels displaying an image; and a life controller controlling at least any one of a compensation rate and a delay rate of the subpixels on the basis of usage data obtained by calculating usage of the display panel and life data of the subpixels.

The life controller may increase the delay rate if the usage data is relatively large and decrease the delay rate if the usage data is relatively small.

The life controller may include: a usage calculation unit calculating usage data of the display panel; a life reference unit storing positions and life of the subpixels; and a rate matching unit comparing the usage data with data of the life reference unit and controlling the compensation rate and the delay rate such that the life of the subpixels is reduced at the same rate.

The usage calculation unit may include at least one of a timer, a data accumulation calculation unit, a per-position accumulation calculation unit, and per-time accumulation calculation unit for calculation of usage of the display panel.

The rate matching unit may control the compensation rate and the delay rate by multiplying a constant "α" to usage data "I" calculated by the usage calculation unit, and the constant a may be calculated by equation 1 below.

$$\alpha=(t_{life,ref}/\tau)^n/I \quad \text{[Equation 1]}$$

$T_{life}=\tau\cdot I^{-n}$, $I^{-n}$: usage equation, τ: life Ref.

Here, $t_{life}$ indicates time required for luminance (or brightness) to decrease, and the life Ref is set to a constant obtained by sensing the life of an actual element.

The rate matching unit may compare the usage data with data of the life reference unit and control the compensation rate and the delay rate such that the life of the subpixels is reduced at the same rate, which may be expressed by Equation 3 below.

$$\alpha(x, y, z, \ldots) * L(x, y, z \ldots) = L_{after} \quad \text{[Equation 3]}$$

x: panel order (example)
y: per-position y coordinate (example)
z: per-position x coordinate (example)

$$\frac{L_{after}}{L(x, y, z, \ldots)} = \alpha(x, y, z, \ldots)$$

Here, L indicates a rate.

The display device may further include: a compensation unit performing compensation such that target luminance is obtained in the subpixels according to sensing values for the subpixels, and outputting a compensation result.

The display device may further include: a delay unit performing degradation delay such that a degradation generated in the subpixels is delayed according to characteristics of an image displayed on the display panel, and outputting a delay result.

In another aspect, a method for driving a display device comprises: storing life data of subpixels of a display panel together with corresponding position; calculating usage of the display panel when an image is displayed on the display unit; and controlling at least any one of a compensation rate and a delay rate of the sub-pixels on the basis of the usage data and life data of the sub-pixels.

The controlling of at least any one of a compensation rate and a delay rate of the sub-pixels on the basis of the usage data and life data of the sub-pixels may include increasing the delay rate if the usage data is relatively large and decreasing the delay rate if the usage data is relatively small.

In the controlling of at least any one of a compensation rate and a delay rate of the sub-pixels on the basis of the usage data and life data of the sub-pixels, the compensation rate and the delay rate may be controlled by multiplying a constant "α" to the usage data "I", wherein the constant a may be calculated by equation 1 below.

$$\alpha=(t_{life,ref}/\tau)^n/I \quad \text{[Equation 1]}$$

$T_{life}=\tau\cdot I^{-n}I^{-n}$: usage equation, τ: life Ref.

Here, $t_{life}$ indicates time required for luminance to decrease, and the life Ref is set to a constant obtained by sensing the life of an actual element.

In the controlling of at least any one of a compensation rate and a delay rate of the sub-pixels on the basis of the usage data and life data of the sub-pixels, the usage data may be compared with data of the life reference unit and the compensation rate and the delay rate may be controlled such that the life of the subpixels is reduced at the same rate, which may be expressed by Equation 3 below.

$$\alpha(x, y, z, \ldots) * L(x, y, z \ldots) = L_{after} \quad \text{[Equation 3]}$$

x: panel order (example)
y: per-position y coordinate (example)
z: per-position x coordinate (example)

$$\frac{L_{after}}{L(x, y, z, \ldots)} = \alpha(x, y, z, \ldots)$$

Here, L indicates a rate.

Further, since compensation is performed such that all the elements included in a display panel have the same life by reflecting life characteristics of the elements, the entire region of the display panel may be degraded substantially at a uniform rate.

Also, since a rate of a delay/compensation algorithm is controlled according to a difference in life between regions of the display panel, an error of the delay/compensation algorithm may be reduced to optimize a compensation performance.

In addition, since the elements of the entire region of the display panel are controlled such that the life thereof come to an end substantially at the same time point, image quality may be uniformly maintained until the life of the display panel comes to an end.

It is to be understood that both the foregoing general description and the following detailed description are exemplary and explanatory and are intended to provide further explanation of the inventive concepts as claimed.

BRIEF DESCRIPTION OF DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Hereinafter, details for carrying out example embodiments of the present disclosure will be described with reference to the accompanying drawings.

A display device described hereinafter may be realized as a television, a video player, a personal computer (PC), a home theater, a smartphone, a virtual reality (VR) device, or the like. Hereinafter, an organic light emitting display device realized on the basis of an organic light emitting diode (OLED) (a light emitting device) will be described as an example of the display device. However, the organic light emitting display device described hereinafter may also be realized on the basis of an inorganic light emitting diode.

Figure 1:
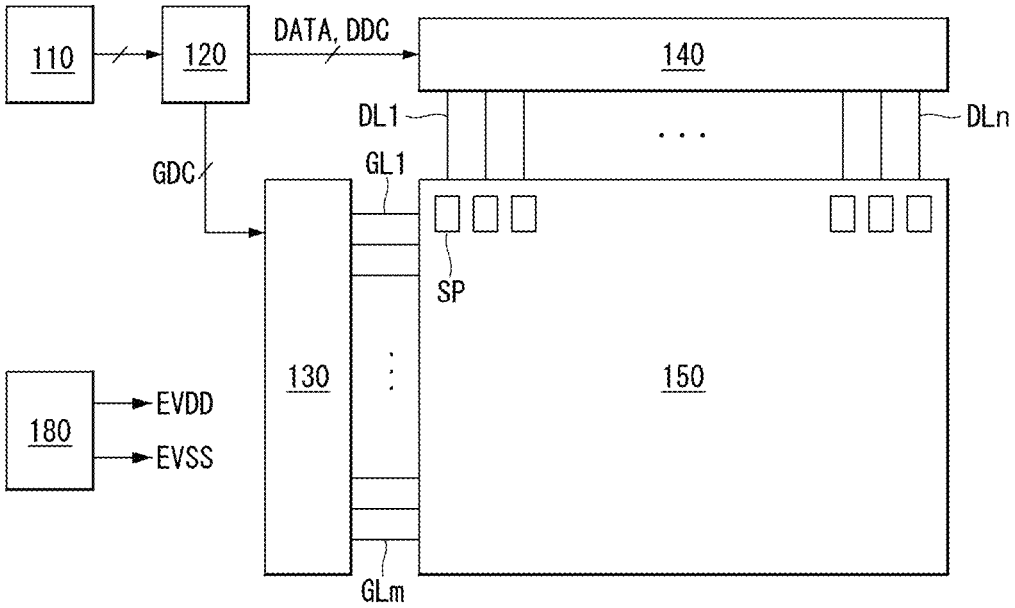
FIG. 1 is a schematic block diagram of a display device.
Figure 2:
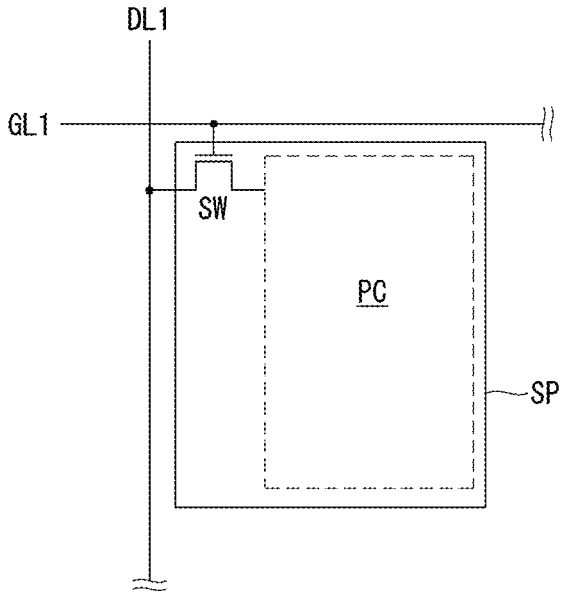
FIG. 2 is a schematic circuit diagram of a subpixel illustrated in FIG. 1.
Figure 3:
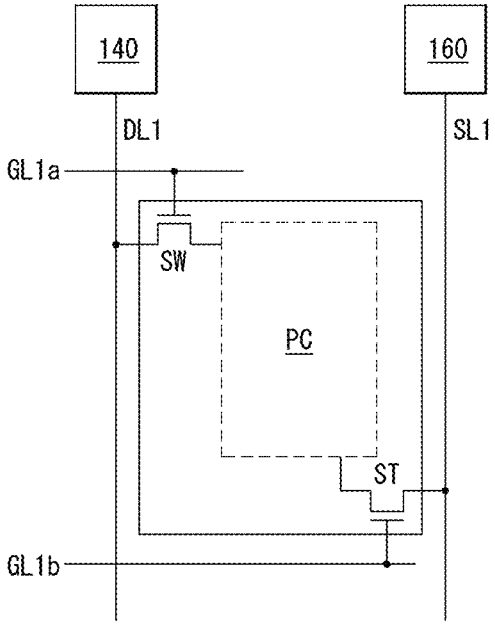
FIG. 3 is a first exemplary view illustrating a configuration of a subpixel having a pixel compensation circuit unit and a device for driving the same.
Figure 4:
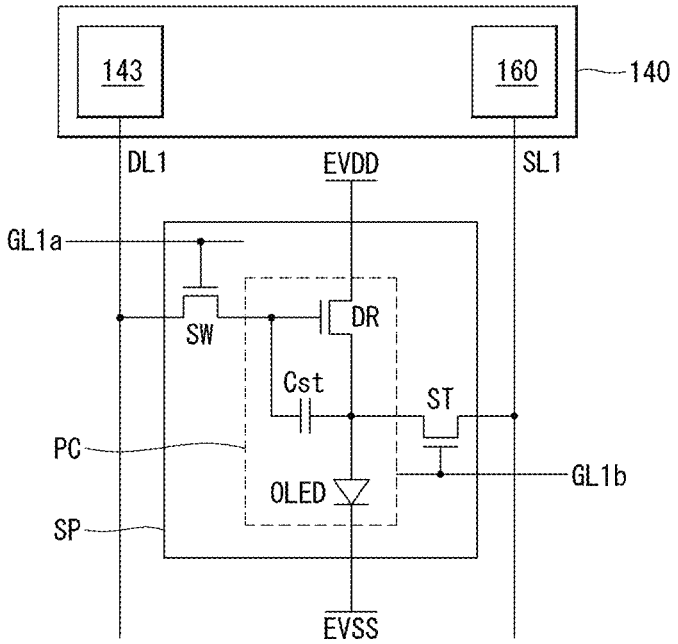
FIG. 4 is a second exemplary view illustrating a configuration of a subpixel having a pixel compensation circuit unit and a device for driving the same.

The display device described hereinafter has a display panel realized on the basis of a P-type transistor or an N-type transistor. In the case of the P-type transistor and the N-type transistor, positions of a source electrode and a drain electrode, except for a gate electrode, may be different according to types, and thus, in order not to limit them, the source electrode and the drain electrode will be referred to as a first electrode and a second electrode. FIG. 1 is a schematic block diagram of a display device, FIG. 2 is a schematic circuit diagram of a subpixel illustrated in FIG. 1, FIG. 3 is a first exemplary view illustrating a configuration of a subpixel having a pixel compensation circuit unit and a device for driving the same, and FIG. 4 is a second exemplary view illustrating a configuration of a subpixel having a pixel compensation circuit unit and a device for driving the same.

As illustrated in FIG. 1, the display device includes an image processing unit 110, a timing controller 120, a data driver 140, a scan driver 130, a display panel 150, and a power supply unit 180.

The image processing unit 110 outputs driving signals for driving various devices together with image data supplied from the outside. The driving signals output from the image processing unit 110 may include a data enable signal, a vertical synchronization signal, a horizontal synchronization signal, and a clock signal, but these signals are omitted for convenience of description.

The timing controller 120 receives a driving signal, and the like, from the image processing unit 110 together with image data. The timing controller 120 outputs a gate timing control signal GDC for controlling an operation timing of the scan driver 130 and a data timing control signal DDC for controlling an operation timing of the data driver 140 on the basis of the driving signal.

The data driver 140 outputs a data signal in response to the data timing control signal DDC supplied from the timing controller 120. The data driver 140 samples and latches a digital data signal DATA supplied from the timing controller 120 to convert the data signal into an analog voltage based on a gamma reference voltage. The data driver 140 outputs the data signal through data lines DL1 to DLn. The data driver 140 may be formed as an integrated circuit (IC).

The scan driver 130 outputs a scan signal in response to the gate timing control signal GDC supplied from the timing controller 120. The scan driver 130 outputs the scan signal through scan lines GL1 to GLm. The scan driver 130 is formed as an integrated circuit (IC) or formed as a gate-in-panel type on the display panel 150.

The power supply unit 180 outputs a high-potential voltage and a low-potential voltage. The high-potential voltage and low-potential voltage output from the power supply unit 180 are supplied to the display panel 150. The high potential voltage is supplied to the display panel 150 through a first power line EVDD and the low potential voltage is supplied to the display panel 150 through a second power line EVSS. The voltage output from the power supply unit 180 may also be used in the data driver 140 or the scan driver 130.

The display panel 150 displays an image corresponding to the data signal and the scan signal supplied from the data driver 140 and the scan driver 130 and power supplied from the power supply unit 180. The display panel 150 includes sub-pixels SP which operate to display an image.

The subpixels SP may include a red subpixel, a green subpixel, and a blue subpixel or a white subpixel, a red subpixel, a green subpixel, and a blue subpixel. The sub-pixels SP may have one or more different emission areas according to emission characteristics.

As illustrated in FIG. 2, one subpixel SP includes a scan line GL1, a data line DL1, a switching transistor SW, and a pixel circuit unit PC. Driving characteristics of the sub-pixel SP vary according to configurations of the pixel circuit unit PC. The pixel circuit unit PC further includes a pixel compensation circuit unit for compensating degradation of an element. Hereinafter, the pixel compensation circuit configured as a single transistor will be described as an example.

As illustrated in FIG. 3, the sub-pixel SP includes a pixel circuit unit PC, a switching transistor SW, and a sensing transistor ST. The pixel circuit unit PC includes a driving transistor, a capacitor, an organic light emitting diode, and the like.

The switching transistor SW performs an operation for supplying a data signal to the inside of the pixel circuit unit PC. The switching transistor SW may be turned on/off in response to a scan signal supplied through a 1*a*-th scan line GL1*a*. The sensing transistor ST performs an operation for sensing the inside of the pixel circuit unit PC. The sensing transistor ST may be turned on/off in response to a sensing signal supplied through a 1*b*-th scan line GL1*b*.

The data driver 140 is connected to the data line DL1. When the switching transistor SW is turned on, the data signal transferred through the data line DL1 is transferred to the capacitor included in the pixel circuit unit PC of the subpixel SP.

An external compensation circuit unit 160 is connected to a sensing line SL1. When the sensing transistor ST is turned on, an element included in the pixel circuit unit PC of the sub-pixel SP is sensed. The external compensation circuit unit 160 may interwork with the sensing transistor ST serving as a pixel compensation circuit unit to sense and compensate for the characteristics of a driving transistor and the organic light emitting diode (OLED) included in the subpixel SP.

The external compensation circuit unit 160 obtains sensing data regarding the characteristics of the element included in at least one sub-pixel through the sensing line SL1. The external compensation circuit unit 160 generates compensation data so that the image data based on the sensing data may be compensated. The compensation data generated by the external compensation circuit unit 160 may be transmitted to the timing controller. However, in case where the external compensation circuit unit 160 is able to perform compensation by itself, the external compensation circuit unit 160 may be provided with the image data from the timing controller and perform compensation on the provided image data.

As illustrated in FIG. 4, the external compensation circuit unit 160 may be included in the data driver 140. In this case, the data driver 140 has the external compensation circuit unit 160 connected to the sensing line SL1 in addition to a signal output unit 143 connected to the data line DL1. Hereinafter, a connection relationship of the elements included in the sub-pixel SP will be described.

In the switching transistor SW, a gate electrode is connected to the 1*a*-th scan line GL1*a*, a first electrode is connected to the data line DL1, and a second electrode is connected to a gate electrode of the driving transistor DR. A first electrode of the driving transistor DR is connected to the first power line EVDD and a second electrode of the driving transistor DR is connected to an anode electrode of the organic light emitting diode OLED. In the capacitor Cst, a first electrode is connected to the gate electrode of the driving transistor DR and a second electrode is connected to the anode electrode of the OLED.

In the organic light emitting diode OLED, the anode electrode is connected to the second electrode of the driving transistor DR and a cathode electrode is connected to the second power line EVSS. In the sensing transistor ST, a gate electrode is connected to the 1*b*-th scan line GL1*b*, a first electrode is connected to the anode electrode of the organic light emitting diode OLED as a sensing node and the second electrode of the driving transistor DR, and a second electrode is connected to the sensing line SL1. Although the la-th scan line GL1*a* and the 1*b*-th scan line GL1*b* are separated from each other by way of example, they may be integrated into one scan line.

Meanwhile, FIG. 4 illustrates the subpixel SP having a 3T (transistor) 1C (capacitor) structure including the switching transistor SW, the driving transistor DR, the capacitor Cst, the organic light emitting diode OLED, and the sensing transistor ST. The sub-pixel SP has been described as an example. However, the subpixel SP may be configured in various manners such as 3T2C, 4T2C, 5T1C, 6T2C, and the like, according to configurations of the pixel compensation circuit unit, and thus, the present invention is not limited thereto.

The display device described above adopts a compensation technique for compensating for a degradation applied to each element or delaying the degradation. However, a degradation delay/compensation algorithm applied to the organic light emitting display device does not consider the life of each element and the related art method displays data of desired luminance by applying a larger gain as the degradation progresses. Thus, in the related art method, since a larger gain is applied as the degradation progresses, the degradation is rather accelerated due to compensation, causing a phenomenon in which the life of the element is shortened. That is, time required for luminance to be reduced to 50% is rather shortened, relative to the case where compensation is not performed.

Thus, in example embodiments of the present invention, life dispersion information of elements is collected in advance at the time of manufacturing display devices and the delay/compensation algorithm application rate is controlled according to life dispersion of each element when the delay/compensation algorithm is applied. For example, although the same delay/compensation value is set, each of the elements generates different luminance if the life thereof is different. An element with the relatively short life is controlled to generate relatively low luminance compared to an element with the long life. Accordingly, the difference in life between the element with the short life and the element with the long life may be reduced.

Figure 5:
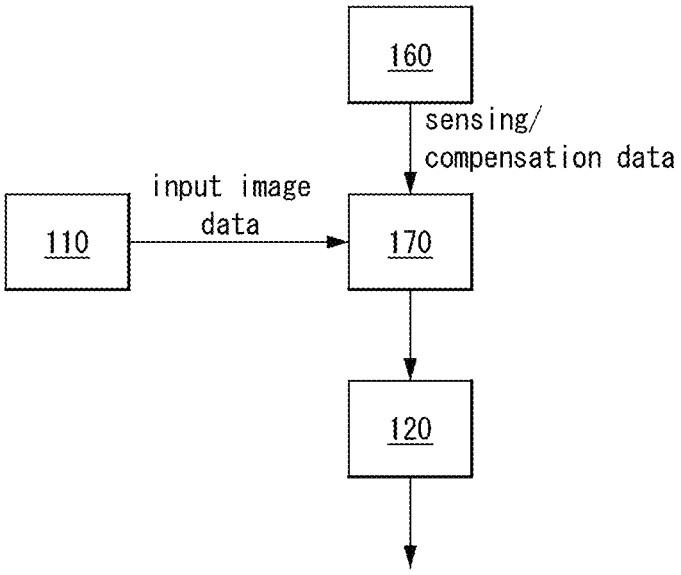
FIG. 5 is a first exemplary view illustrating a configuration of a display device having a life controller according to an embodiment of the present invention.
Figure 6:
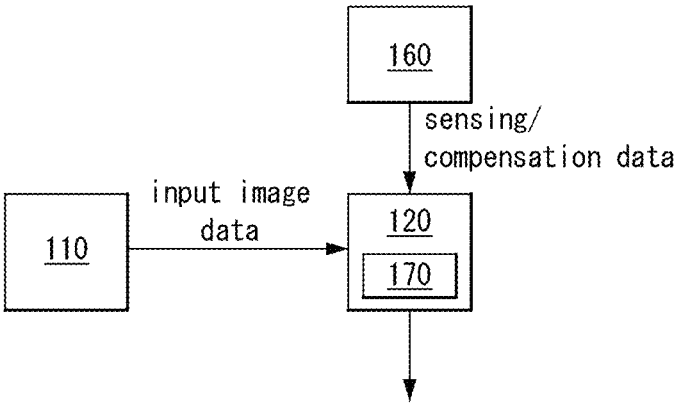
FIG. 6 is a second exemplary view illustrating a configuration of a display device having a life controller according to an embodiment of the present invention.
Figure 7:
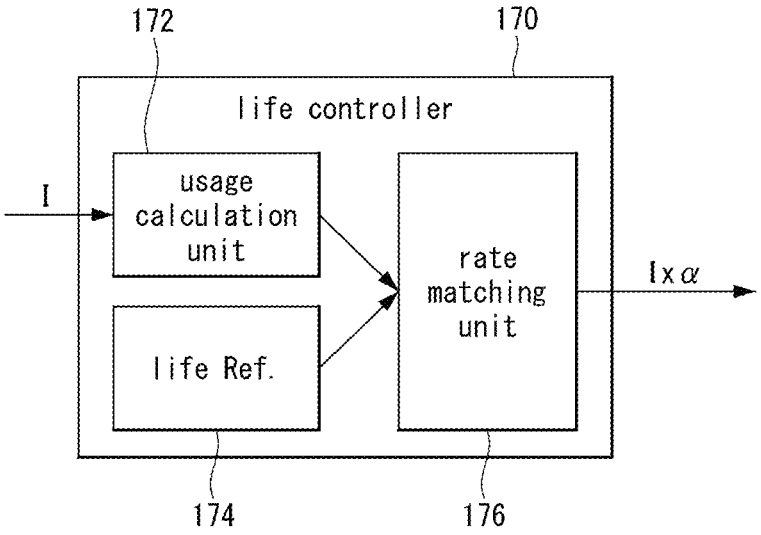
FIG. 7 is a block diagram of a life controller according to an embodiment of the present invention.

FIG. 5 is a first exemplary view illustrating main circuits of a display device according to an embodiment of the present invention, FIG. 6 is a second exemplary view illustrating main circuits of a display device according to an embodiment of the present invention, and FIG. 7 is a block diagram specifically illustrating a life controller illustrated in FIGS. 5 and 6.

As illustrated in FIG. 5, the display device according to a first embodiment of the present invention includes the image processing unit 110, the external compensation circuit unit 160, a life controller 170, and the timing controller 120.

As illustrated in FIG. 6, the display device according to a second embodiment of the present invention includes the image processing unit 110, the external compensation circuit unit 160, the life controller 170, and the timing controller 120. The life controller 170 is included in the timing controller 120.

The life controller 170 illustrated in FIGS. 5 and 6 controls the life of the elements included in the display panel to come to an end at the substantially same time. The life controller 170 may estimate a usage according to input image data transferred from the image processing unit 110 and calculate a rate of degradation compensation/degradation delay compensation to be applied to each element according to stored life/performance dispersion information of each element. Accordingly, life uniformity of the elements may be enhanced by differentially applying the rate of degradation compensation/degradation delay compensation according to life/performance dispersion.

Hereinafter, the life controller 170 will be described in detail as follows.

As illustrated in FIG. 7, the life controller 170 includes a usage calculation unit 172, a life reference (Ref.) unit 174, and a rate matching unit 176.

The usage calculation unit 172 calculates usage of the display panel when an image is finally displayed after the processing of the input image data is completed. The display panel usage may be calculated as the sum of currents I used to display the input image. The usage calculation unit 172 may include components which may be able to calculate usage such as a timer, data accumulation, an accumulation by position, an accumulation by time, and the like.

Figure 8:
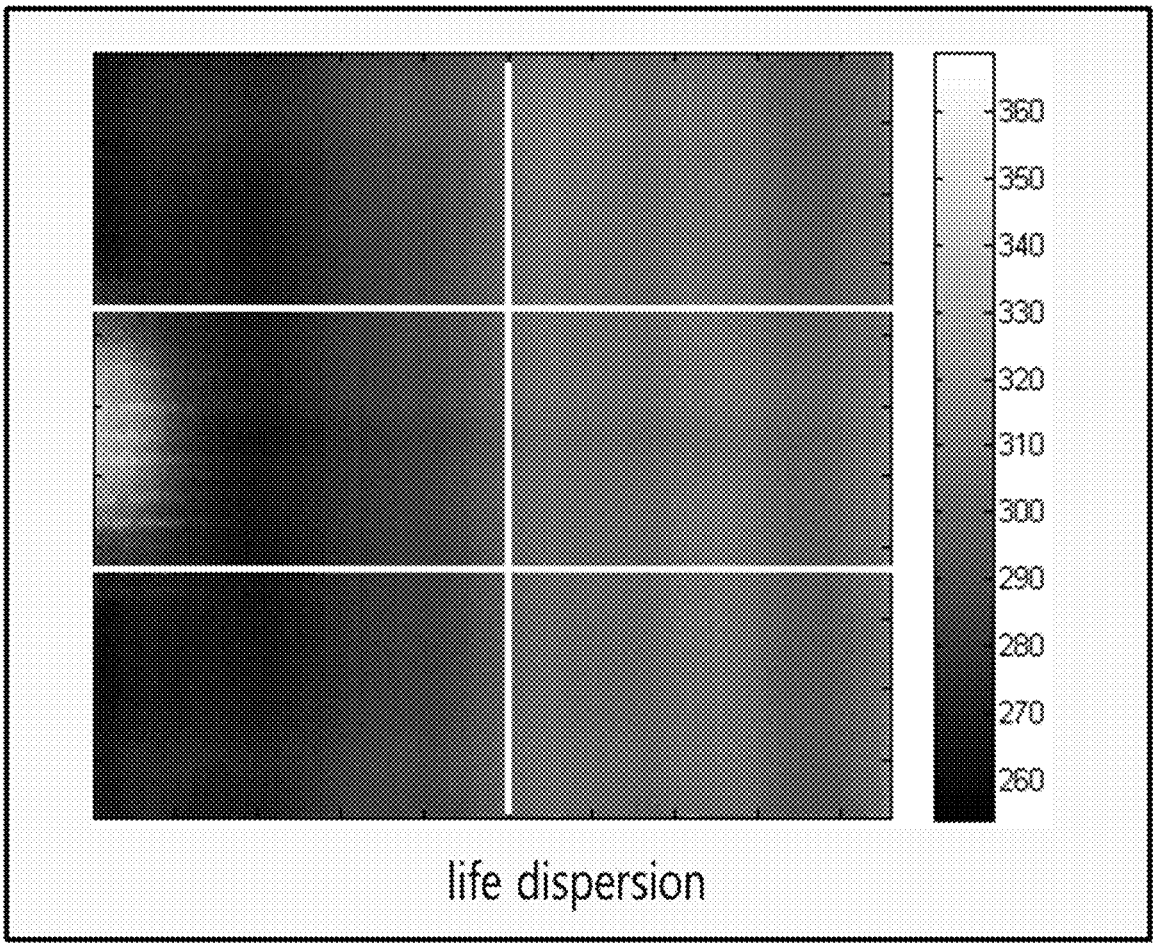
FIG. 8 is a graph illustrating a life reference map according to an embodiment of the present invention.

The life reference (Ref.) unit 174 includes information on positions and life information of elements in the display panel. The life reference (Ref.) unit 174 may include life information composed of values representing the life of the elements by location, region, or constant, and the like. Referring to FIG. 8, the elements in the display panel may have different performance and life. The performance and life of the elements are non-uniformly distributed according to process variations, driving time, driving environment, and the like. The life reference (Ref.) unit 174 may store life information of each element measured at the time of manufacturing of the display panel.

The rate matching unit 176 compares current usage of the display panel calculated by the usage calculation unit 172 with the life reference (Ref.) unit 174. If the current usage is greater, the rate matching unit 176 increases the degree of delay, and if the current usage is smaller, the rate matching unit 176 lowers the degree of delay. In this manner, the rate matching unit controls the remaining life of all the elements to be similar. Thus, the rate matching unit 176 outputs $I^*\alpha$ corrected by multiplying a constant "α" to the original usage I. Here, the constant a may be expressed by Equation 1 below.

$$\alpha=(t_{life,ref}/\tau)^n/I \quad \text{[Equation 1]}$$

$T_{life}=\tau\cdot I^{-n}$, $I^{-n}$: usage equation, τ: life Ref.

Here, $t_{life}$ denotes time required for luminance to decrease. For example, $t_{50}$ may refer to time required for luminance to be halved to 50%. $t_{life}$ may be set to vary according to system design methods, such as 20%, 30%, and 40%. The life Ref may be set to a constant obtained by sensing the life of the actual element.

Figure 9:
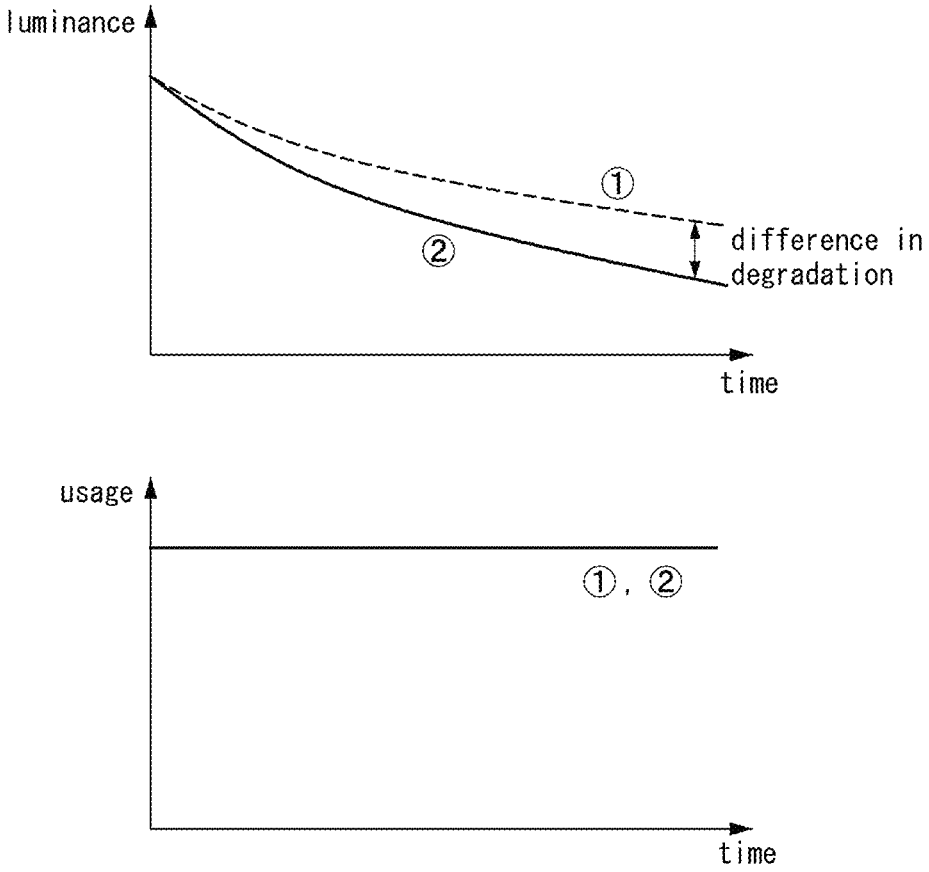
FIGS. 9 and 10 are graphs illustrating an operation of a life controller according to the embodiment of the present invention.
Figure 10:
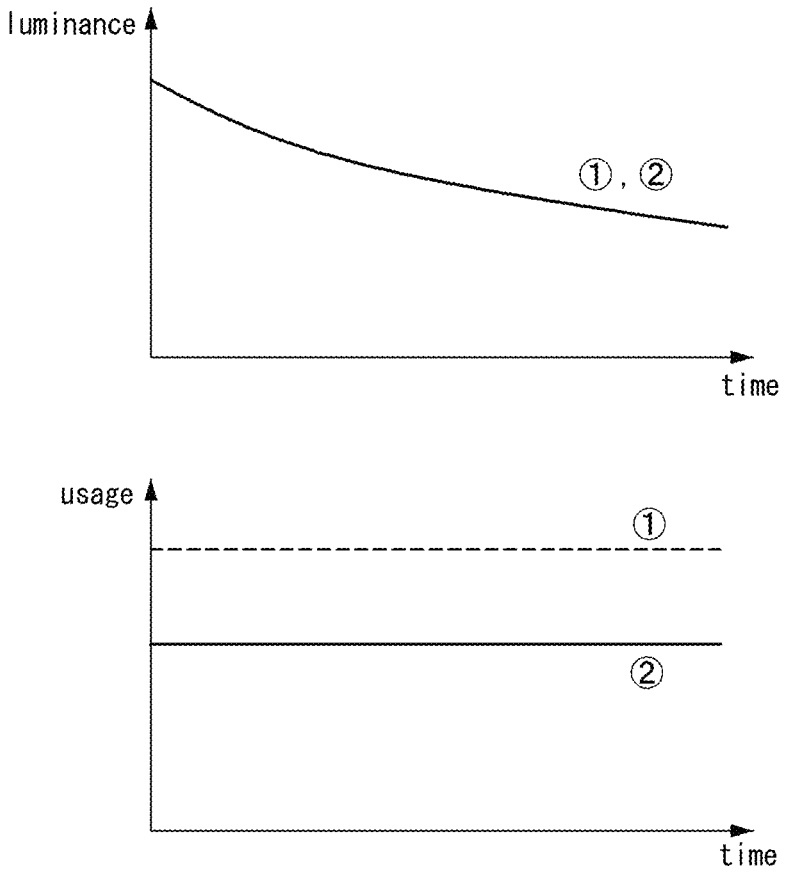

The principle of rate matching will be described in detail with reference to FIGS. 9 and 10. FIGS. 9 and 10 are graphs illustrating the characteristics of elements at points ① and ② of different positions.

According to the time and luminance graph of FIG. 9, it can be seen that the elements at points ① and ② exhibit the same luminance at first but the luminance of the element at the point ② decreases more rapidly as time passes. That is, since the life of the element at the point ② is relatively shorter than the life of the element at the point ①, luminance at the point ② is darker than the point ① although the same time is used, causing non-uniformity of luminance. For this reason, as illustrated in the graph of time and usage of FIG. 9, if the elements at the points ① and ② are used under the same conditions, the degradation of the element at the point ② progresses more rapidly.

FIG. 10 is a view illustrating the principle of controlling the remaining life of all elements to be similar according to an embodiment of the present invention. As discussed in FIG. 9, the life of the element at the point ② is relatively shorter than the life of the element at the point ①. Thus, in order to match the life of the elements at the points ① and ②, usage of the element at the point ② must be relatively reduced. That is, as illustrated in the graph of time and usage of FIG. 10, use time of the elements is controlled to be different such that the element at the point ② is used less than the element at the point ①. The rate matching unit 176 controls the remaining life of all the elements to be similar in a manner of increasing the degree of delay if current usage of each element is large and decreasing the degree of delay if current usage is small on the basis of the life reference (Ref.) unit 174. As a result, as illustrated in the graph of time and luminance of FIG. 10, degradations of the element at the point ① and the element at the point ② progress at the substantially same rate, preventing generation of a different in luminance between the points ① and ② although time passes.

As described above, an equation for calculating the rate of the degradation compensation/degradation delay compensation to be applied to each element according to the life information of the elements at the point ① and the element at the point ② is as follows.

$$t_{life,①} = \tau_{①} \cdot I^{-n} \qquad t_{life,②} = \tau_{②} \cdot I^{-n}$$

degradation rate adjustmen

× α

[Equation 2]

$$t_{life,ref} = \tau_{①} \cdot (I \cdot \alpha_{①})^{-n} \qquad t_{life,ref} = \tau_{②} \cdot (I \cdot \alpha_{②})^{-n}$$

Here, $t_{50}=\tau \cdot I^{-n}$, $I^{-n}$: usage equation, τ: life Ref

Here, $t_{life}$ refers to time required for luminance to decrease. For example, $t_{50}$ may refer to time required for luminance to be halved to 50%. $t_{life}$ may be set to vary according to system design methods, such as 20%, 30%, 40%, and the like. The life Ref may be set to a constant obtained by sensing the life of an actual element.

In order to adjust the degradation rate as described above, the rate matching unit 176 outputs I*α corrected by multiplying a constant "α" to the original usage I. The constant a may be expressed by the equation below.

$$\alpha = (t_{life,ref}/\tau)^n/I \begin{cases} \alpha_{①} = (t_{life,ref}/\tau_{①})^n/I \\ \alpha_{②} = (t_{life,ref}/\tau_{②})^n/I \end{cases}$$

The image is displayed on the display panel according to "I*α" corrected through the calculation process. The rate of the degradation compensation/degradation delay compensation to be applied to each element, that is, I*a, is calculated to be different according to the life information of the element at the point ① and the element at the point ②, and, as a result, the element at the point ① and the element at the point ② may be degraded at the substantially same rate.

For example, when $t_{life}$ is set to a time for luminance to be halved to 50%, the above equation may be expressed as follows.

$$\alpha = (t_{50,ref}/\tau)^n/I \begin{cases} \alpha_{①} = (t_{50,ref}/\tau_{①})^n/I \\ \alpha_{②} = (t_{50,ref}/\tau_{②})^n/I \end{cases}$$

As described above, the elements included in the display panel have different life, and the difference in life may cause non-uniformity of luminance of an image in the long term. In order to prevent this, life information of the elements in the display panel which is acquired in advance at the stage of manufacturing of the display device is stored in the life reference unit 174, and a rate of degradation compensation/degradation delay compensation to be applied to each element may be differentially applied according to life information of each element, whereby life uniformity of the elements may be improved.

Figure 11:
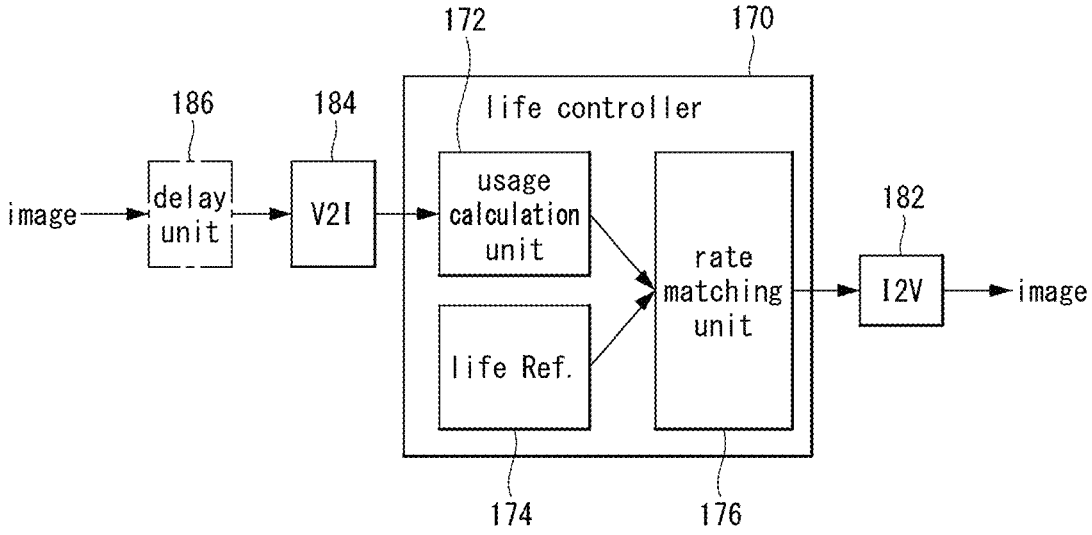
FIG. 11 is a first exemplary view illustrating main circuits of a display device according to an embodiment of the present invention.

FIG. 11 is a first exemplary view illustrating main circuits of a display device according to an embodiment of the present invention.

As illustrated in FIG. 11, the display device according to the first embodiment of the present invention includes a delay unit 186, a voltage/current conversion unit 184, a life controller 170, and a current/voltage conversion unit 182.

The delay unit 186 may perform a delay algorithm generally used for improving image quality of the display device. For example, the delay unit 186 may perform various delay algorithms applied in the art, such as luminance reduction prevention or peak luminance algorithm, a degradation delay algorithm, an HDR algorithm, and the like.

The voltage/current conversion unit 184 converts an image signal processed by the delay unit 186 into a current value and delivers the current value to the life controller 170.

The life controller 170 includes a usage calculation unit 172, a life reference (Ref.) unit 174, and a rate matching unit 176.

The usage calculation unit 172 calculates usage of the display panel when an image is finally displayed after processing of input image data is completed. The display panel usage may be calculated as the sum of currents I used to display the input image. The usage calculation unit 172 may include components which may be able to calculate usage, such as a timer, data accumulation, accumulation by position, an accumulation by time, and the like.

The life reference (Ref.) unit 174 includes information on positions and life information of elements in the display panel. The life reference (Ref.) unit 174 may include life information composed of values representing the life of the elements by location, region, or constant, and the like. The elements in the display panel may have different performance and life. The performance and life of the elements are non-uniformly distributed according to process variations, driving time, driving environment, and the like. The life reference (Ref.) unit 174 may store life information of each element measured at the time of manufacturing of the display panel.

The rate matching unit 176 compares current usage of the display panel calculated by the usage calculation unit 172 with the life reference (Ref.) unit 174.

If the current usage is greater, the rate matching unit 176 increases the degree of delay, and if the current usage is smaller, the rate matching unit 176 lowers the degree of delay. In this manner, the rate matching unit controls the remaining life of all the elements to be similar. Whether the current usage is large or small according to a life reference may be determined with the constant α. The constant α reflects a position, a panel, process dispersion, and the like, and the rate L may be matched by comparing the constant α. The constant α may be expressed as Equation 3 below.

$$\alpha(x, y, z, \ldots) * L(x, y, z \ldots) = L_{after} \qquad \text{[Equation 3]}$$

x: panel order (example)

y: per-position y coordinate (example)

z: per-position x coordinate (example)

$$\frac{L_{after}}{L(x, y, z, \ldots)} = \alpha(x, y, z, \ldots)$$

As described above, the life dispersion acquired in advance is reflected on a delay rate when the delay algorithm is applied, whereby the same luminance is generated even at different positions, different regions, or different panels when the same algorithm is applied. Therefore, when the same usage occurs in all the elements, the same luminance may be obtained and the same life may be obtained.

Meanwhile, although the configuration of the delay unit 186 is replaced with a "compensation unit", the same configuration may be applied. The compensation unit may perform a compensation algorithm generally used for improving image quality of the display device. Currently, many compensation algorithms compensate for luminance by increasing luminance of a partial region or by adjusting luminance of a specific pattern, and the like. However, the existing compensation method by the "compensation unit" is a method which does not consider the life of each element. Therefore, when the same algorithm is applied by reflecting a previously obtained life dispersion on the degree of compensation in applying the compensation algorithm, the same luminance is generated even at different positions, different regions, and different panels. If the life is basically different, different luminance appears in spite of the same compensation value, which results in a compensation error. Thus, if the same usage is generated in all the elements, the same luminance may appear and the same life may be obtained. Using this, difference in the life only in some panels or some regions may be prevented and luminance error dispersion may be reduced.

Figure 12:
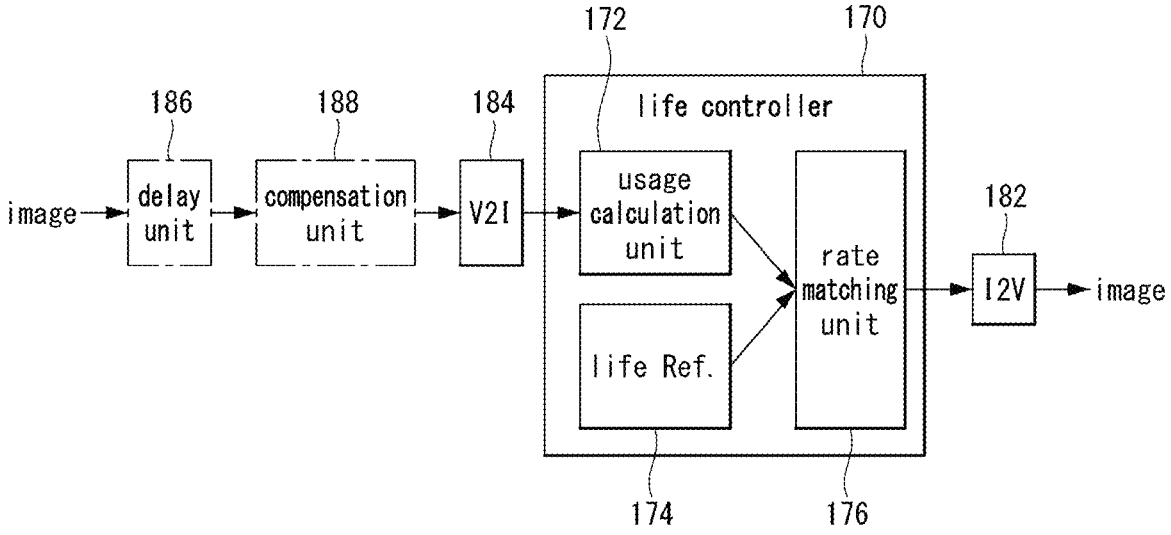
FIG. 12 is a second exemplary view illustrating main circuits of a display device according to an embodiment of the present invention.

FIG. 12 is a second exemplary view illustrating main circuits of A display device of an embodiment of the present invention, in which a case where the configuration of a compensation unit 188 is added as compared with FIG. 11.

As illustrated in FIG. 12, the display device according to the first embodiment of the present invention includes a delay unit 186, a compensation unit 188, a voltage/current conversion unit 184, a life controller 170, and a current/voltage conversion unit 182.

The delay unit 186 may perform a delay algorithm generally used for improving image quality of the display device. For example, the delay unit 186 may perform various delay algorithms applied in the art, such as luminance reduction prevention or peak luminance algorithm, a degradation delay algorithm, an HDR algorithm, and the like.

The compensation unit 188 may perform a compensation algorithm generally used for improving image quality of the display device. Currently, many compensation algorithms compensate for luminance by increasing luminance of a partial region or by adjusting luminance of a specific pattern, and the like.

The voltage/current conversion unit 184 converts an image signal processed by the delay unit 186 and the compensation unit 188 into a current value and delivers the current value to the life controller 170.

The life controller 170 includes the usage calculation unit 172, the life reference (Ref.) unit 174, and the rate matching unit 176.

The usage calculation unit 172 calculates usage of the display panel when an image is finally displayed after processing of input image data is completed. The display panel usage may be calculated as the sum of currents I used to display the input image. The usage calculation unit 172 may include components which may be able to calculate usage, such as a timer, data accumulation, accumulation by position, an accumulation by time, and the like.

The life reference (Ref.) unit 174 includes information on positions and life information of elements in the display panel. The life reference (Ref.) unit 174 may include life information composed of values representing the life of the elements by location, region, or constant, and the like. The elements in the display panel may have different performance and life. The performance and life of the elements are non-uniformly distributed according to process variations, driving time, driving environment, and the like. The life reference (Ref.) unit 174 may store life information of each element measured at the time of manufacturing of the display panel.

The rate matching unit 176 compares current usage of the display panel calculated by the usage calculation unit 172 with the life reference (Ref.) unit 174. If the current usage is greater, the rate matching unit 176 increases the degree of delay, and if the current usage is smaller, the rate matching unit 176 lowers the degree of delay. In this manner, the rate matching unit controls the remaining life of all the elements to be similar.

The rate matching unit 176 reflects the life acquired in advance in the life reference (Ref.) Unit 174 to the delay speed when the delay/compensation algorithm is applied, Or the same luminance may be generated in different panels. If the life of each element is different, different luminance is displayed even with the same delay/compensation value, and this appears as dispersion of luminance error. Thus, embodiments of the present invention may exhibit the same luminance and the same life when the same amount of usage occurs in all the devices.

The rate matching unit 176 may generate the same luminance even at different positions, different regions, or different panels when the same algorithm is applied, by reflecting life dispersion obtained in advance from life reference (Ref.) unit 174 on a delay rate and on the degree of compensation when the delay/compensation algorithm is applied. If unique life of each element is different, different luminance may be obtained in spite of the same delay/compensation value, which results in a luminance error dispersion. Thus, when the same usage occurs in all the elements, the same luminance may be obtained and the same life may be obtained.

As described above, since compensation is performed such that all the elements included in a display panel have the same life by reflecting life characteristics of the elements, the entire region of the display panel may be degraded substantially at a uniform rate. Also, since a rate of a delay/compensation algorithm is controlled according to a difference in life between regions of the display panel, an error of the delay/compensation algorithm may be reduced to optimize a compensation performance. In addition, since the elements of the entire region of the display panel are controlled such that the life thereof come to an end substantially at the same time point, image quality may be uniformly maintained until the life of the display panel comes to an end.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel including subpixels configured to display an image; and a life controller configured to control at least any one of a compensation rate and a delay rate of the subpixels on the basis of current usage data obtained by calculating current usage of the display panel and life data of the subpixels, wherein the life controller includes:

a usage calculation unit configured to calculate the current usage data of the display panel;

a life reference unit configured to store the life data of the subpixels, the life data including information on positions and life information of the subpixels; and a rate matching unit configured to compare the current usage data with the life data of the life reference unit and to control the at least any one of the compensation rate and the delay rate such that the life of the subpixels is reduced at the same rate, wherein the life controller controls at least any one of the compensation rate and the delay rate by multiplying a constant "α" to the current usage data "I", and the constant a may be calculated by Equation 1 below:

$$\alpha=(t_{life,ref}/\tau)^n/I \quad \text{[Equation 1]}$$

$t_{life}=\tau\cdot I^{-n}$, $I^{-n}$: usage equation, τ: life Ref where $t_{life}$ indicates time required for luminance to decrease, and the life Ref is set to a constant obtained by sensing the life of an actual element.

2. The display device of claim 1, wherein the life controller increases the delay rate if the current usage data is relatively large and decreases the delay rate if the current usage data is relatively small.

3. The display device of claim 1, wherein the usage calculation unit includes at least one of a timer, a data accumulation calculation unit, a per-position accumulation calculation unit, and per-time accumulation calculation unit for calculation of the current usage of the display panel.

4. The display device of claim 1, wherein the rate matching unit controls the compensation rate and the delay rate by multiplying the constant "α" to the current usage data "I" calculated by the usage calculation unit, and the constant α may be calculated by equation 1 below:

$$\alpha=(t_{life,ref}/\tau)^n/I \quad \text{[Equation 1]}$$

$T_{life}=\tau\cdot I^{-n}$, $I^{-n}$: usage equation, τ: life Ref.

where $t_{life}$ indicates time required for luminance to decrease, and the life Ref is set to a constant obtained by sensing the life of an actual element.

5. The display device of claim 1, wherein the rate matching unit compares the current usage data with data of the life reference unit and controls the compensation rate and the delay rate such that the life of the subpixels is reduced at the same rate, which may be expressed by Equation 3 below:

$$\alpha(x, y, z, \ldots) * L(x, y, z \ldots)=L_{after} \quad \text{[Equation 3]}$$

x: panel order (example)

y: per-position y coordinate (example)

z: per-position x coordinate (example)

$$\frac{L_{after}}{L(x, y, z, \ldots)} = \alpha(x, y, z, \ldots)$$

where L indicates a rate.

6. The display device of claim 1, further comprising: a compensation unit configured to perform a compensation such that target luminance is obtained in the subpixels according to sensing values for the subpixels, and to output a compensation result.

7. The display device of claim 1, further comprising: a delay unit configured to perform a degradation delay such that a degradation generated in the subpixels is delayed according to characteristics of an image displayed on the display panel, and to output a delay result.

8. A method for driving a display device, the method comprising:

storing life data of subpixels of a display panel together with corresponding position;

calculating a current usage data of the display panel when an image is displayed on the display unit; and controlling at least any one of a compensation rate and a delay rate of the sub-pixels on the basis of the current usage data and life data of the sub-pixels, wherein, in the controlling of at least any one of the compensation rate and the delay rate of the sub-pixels on the basis of the current usage data and life data of the sub-pixels, the compensation rate and the delay rate are controlled by multiplying a constant "α" to the current usage data "I", wherein the constant a may be calculated by equation 1 below:

$$\alpha=(t_{life,ref}/\tau)^n/I \quad \text{[Equation 1]}$$

$t_{life}=\tau\cdot I^{-n}$, $I^{-n}$: usage equation, τ: life Ref.

where, $t_{life}$ indicates time required for luminance to decrease, and the life Ref is set to a constant obtained by sensing the life of an actual element.

9. The method of claim 8, wherein the controlling of at least any one of a compensation rate and a delay rate of the sub-pixels on the basis of the current usage data and life data of the sub-pixels includes increasing the delay rate if the current usage data is relatively large and decreasing the delay rate if the current usage data is relatively small.

10. The method of claim 8, wherein in the controlling of at least any one of a compensation rate and a delay rate of the sub-pixels on the basis of the current usage data and life data of the sub-pixels, the current usage data is compared with data of the life reference unit and the compensation rate and the delay rate are controlled such that the life of the subpixels is reduced at the same rate, which may be expressed by Equation 3 below:

$$\alpha(x, y, z, \ldots) * L(x, y, z \ldots)=L_{after} \quad \text{[Equation 3]}$$

x: panel order (example)

y: per-position y coordinate (example)

z: per-position x coordinate (example)

$$\frac{L_{after}}{L(x, y, z, \ldots)} = \alpha(x, y, z, \ldots)$$

where L indicates a rate.

11. The method of claim 8, wherein the controlling of at least any one of a compensation rate and a delay rate of the sub-pixels on the basis of the current usage data and life data of the sub-pixels includes comparing the current usage data with the life data to control the at least any one of the compensation rate and the delay rate such that the life of the subpixels is reduced at the same rate.

* * * * *